US009353744B2

(12) United States Patent
Kobayashi

(10) Patent No.: US 9,353,744 B2
(45) Date of Patent: May 31, 2016

(54) VANE-TYPE HYDRAULIC DEVICE HAVING VANE FORMED WITH ENGAGING GROOVE

(75) Inventor: Yuta Kobayashi, Tokyo (JP)

(73) Assignee: TBK Co., Ltd., Tokyo (JP)

( * ) Notice: Subject to any disclaimer, the term of this patent is extended or adjusted under 35 U.S.C. 154(b) by 132 days.

(21) Appl. No.: 14/352,747

(22) PCT Filed: Oct. 18, 2011

(86) PCT No.: PCT/JP2011/005809

§ 371 (c)(1),
(2), (4) Date: Apr. 18, 2014

(87) PCT Pub. No.: WO2013/057752

PCT Pub. Date: Apr. 25, 2013

(65) Prior Publication Data

US 2014/0241927 A1 Aug. 28, 2014

(51) Int. Cl.
*F03C 2/00* (2006.01)
*F03C 4/00* (2006.01)
(Continued)

(52) U.S. Cl.
CPC ..... *F04C 14/22* (2013.01); *F01C 21/0836* (2013.01); *F04C 2/3442* (2013.01); *F04C 2/3446* (2013.01); *F01C 21/108* (2013.01); *F04C 14/223* (2013.01)

(58) Field of Classification Search
CPC ..... F04C 2/344; F04C 2/3442; F04C 2/3446; F04C 14/22; F04C 14/223; F01C 21/0809; F01C 21/0818; F01C 21/0836; F01C 21/0863; F01C 21/108
USPC ..... 418/24, 26–28, 30–31, 259–260, 265
See application file for complete search history.

(56) References Cited

U.S. PATENT DOCUMENTS

| | | | |
|---|---|---|---|
| 4,799,867 | A | 1/1989 | Sakamaki et al. |
| 4,955,985 | A | 9/1990 | Sakamaki et al. |
| 2006/0104823 | A1 | 5/2006 | Hunter et al. |

FOREIGN PATENT DOCUMENTS

| | | | |
|---|---|---|---|
| EP | 1001172 | A1 | 5/2000 |
| GB | 2197689 | A | 5/1988 |

(Continued)

OTHER PUBLICATIONS

An Office Action; "Notification of Reasons of Rejection," issued by the Japanese Patent Office on Jun. 30, 2015, which corresponds to Japanese Patent Application No. 2013-539405 and is related to U.S. Appl. No. 14/352,747; with English language translation.

(Continued)

*Primary Examiner* — Theresa Trieu
(74) *Attorney, Agent, or Firm* — Studebaker & Brackett PC

(57) ABSTRACT

A vane pump (1) includes: a front side vane case (40), a rear side vane case (50), a pump housing (60), a pump cover (70), a drive shaft (30), a rotationally driven rotor (10), and vanes (20) provided in slot sections (13), wherein engaging groove sections and guide protrusions (46, 52), which engaging one another, are provided in the vanes (20), the front side vane case (40) and the rear side vane case (50), the engaging groove sections and guide protrusions (46, 52) are composed in such a manner that the vanes (20) move following a proximal inner peripheral surface (42*b*) in a state where the vane is proximate to the proximal inner peripheral surface (42*b*), in accordance with rotation of the rotor (10), and pump chambers are demarcated by the vanes (20) situated in proximity with the proximal inner peripheral surface (42*b*).

6 Claims, 11 Drawing Sheets

(51) Int. Cl.

| | |
|---|---|
| ***F04C 2/00*** | (2006.01) |
| ***F04C 14/22*** | (2006.01) |
| ***F01C 21/08*** | (2006.01) |
| ***F04C 2/344*** | (2006.01) |
| *F01C 21/10* | (2006.01) |

(56) References Cited

FOREIGN PATENT DOCUMENTS

| | | | |
|---|---|---|---|
| JP | S48-02402 | | 1/1973 |
| JP | S48-2402 | A | 1/1973 |
| JP | S49-132607 | | 12/1974 |
| JP | S49-132607 | A | 12/1974 |
| JP | S56-70183 | | 6/1981 |
| JP | S56-70183 | U | 6/1981 |
| JP | S63-124885 | A | 5/1988 |
| JP | 2007-146839 | A | 6/2007 |
| JP | 2009-281271 | A | 12/2009 |

OTHER PUBLICATIONS

The extended European search report issued by the European Patent Office on Jun. 19, 2015, which corresponds to European Patent Application No. 11874181.8-1608 and is related to U.S. Appl. No. 14/352,747.

International Search Report; PCT/JP2011/005809; Jan. 17, 2012.

"Notification of First Office Action," issued by the Chinese Patent Office on Aug. 24, 2015, which corresponds to Chinese Patent Application No. 201180074250.4 and is related to U.S. Appl. No. 14/352,747; with English language translation.

VANE-TYPE HYDRAULIC DEVICE HAVING VANE FORMED WITH ENGAGING GROOVE

TECHNICAL FIELD

The present invention relates to a vane-type hydraulic device which includes a rotor on which vanes are provided in a retractable fashion.

TECHNICAL BACKGROUND

A vane pump, which is one example of the abovementioned vane-type hydraulic device, is generally composed by installing vanes so as to be retractable in a radial direction, in each of a plurality of slots formed in a rotor, the rotor on which the vanes are installed being accommodated in an eccentric fashion with respect to an inner peripheral surface of a pump housing. In this way, by causing the rotor to rotate while the vanes press against the inner peripheral surface of the pump housing, with the rotor in an eccentric state with respect to the inner peripheral surface of the pump housing, it is possible to alter the volume of the pump chambers which are formed when the vanes demarcate the gap between the rotor and the pump housing, in accordance with the rotation of the rotor. The vane pump is composed in such a manner that fluid is taken in and discharged by altering the volume of the pump chamber in this way. In other words, fluid is taken into the pump chamber in the portion where the volume of the pump chamber increases, and conversely, the fluid in the pump chamber is discharged in the portion where the volume of the pump chamber decreases.

As described above, as a mechanism for forming a pump chamber by constantly pressing vanes against the inner peripheral surface of a pump housing which is provided eccentrically with respect to a rotor, a mechanism is known in the prior art, in which vanes are pressed against the inner peripheral surface of the pump housing with a force corresponding to the discharge pressure, by guiding the discharge pressure of the fluid to a vane back pressure chamber. Furthermore, a mechanism is also known in the prior art, in which vanes are pressed constantly against the inner peripheral surface of the pump housing, regardless of the amount of eccentricity of the rotor with respect to the inner peripheral surface of the pump housing, by using the impelling force of a spring to cause the vanes to project.

PRIOR ARTS LIST

Patent Document

Patent Document 1: Japanese Laid-Open Patent Publication No. 2009-281271(A)

SUMMARY OF THE INVENTION

Problems to be Solved by the Invention

However, if a conventional composition is adopted in which the discharge pressure of the fluid is used to press vanes against the inner peripheral surface of the pump housing, then the rotor is driven to rotate in a state where all of the front tips of the vanes are pressed against the inner peripheral surface of the pump housing, constantly, with a force corresponding to the discharge pressure of the fluid. Consequently, there has been a problem in that the frictional resistance between the front tips of the vanes and the inner peripheral surface of the pump housing becomes greater, and it is difficult to improve the mechanical efficiency of the vane pump. Furthermore, in a conventional configuration, it is necessary to provide a vane back pressure chamber in the base end portion of the slots and to guide the discharge pressure of the fluid to this back pressure chamber, and hence there is a problem in that the vane pump tends to become complicated and large in size.

The present invention was devised in view of the problems described above, an object thereof being to provide a vane-type hydraulic device which improves mechanical efficiency, while involving a relatively simple and compact structure.

Means to Solve the Problems

In order to achieve the abovementioned object, the vane-type hydraulic device relating to the present invention (for example, the vane pump 1 in the embodiment) is a vane-type hydraulic device, including: a rotor accommodating member provided with a rotor accommodating space; a drive shaft supported by the rotor accommodating member; a rotor provided with a slot section formed to extend in a radial direction of the rotor, the rotor being disposed inside the rotor accommodating space and being driven to rotate about the drive shaft by the drive shaft; and a vane provided retractably in the radial direction in the slot section, wherein the vane and the rotor accommodating member are provided with engaging sections which engaging each other; and the engaging sections are composed so as to cause the vane to move following the inner peripheral surface of the rotor accommodating member (for example, the proximal inner peripheral surface 42*b* in the embodiment) in a state where the vane is proximate to the inner peripheral surface of the rotor accommodating member, in accordance with rotation of the rotor, as well as to demarcate a pump chamber by the vane which is in proximity to the inner peripheral surface of the rotor accommodating member.

In the vane-type hydraulic device described above, it is desirable to adopt a composition in which the amount of eccentricity of the inner peripheral surface of the vane case with respect to the rotor can be changed, by composing the rotor accommodating member from a vane case which is provided with the rotor accommodating space (for example, the front side vane case 40 and the rear side vane case 50 in the embodiment), and a case accommodating housing which is provided with a case accommodating space for accommodating the vane case movably in a plane perpendicular to the drive shaft (for example, the pump housing 60 and pump cover 70 in the embodiment), and allowing the vane case to move inside the case accommodating space of the case accommodating housing.

Furthermore, desirably, the vane case is accommodated in a linearly movable fashion inside the case accommodating space, and the amount of eccentricity is changed by means of the vane case performing the linear movement inside the case accommodating space.

Desirably, the case accommodating housing is provided with an impelling member (for example, the compression spring 62 in the embodiment) which impels the vane case towards one side in the direction of linear movement, and the vane case is pressed to the other side against the impelling force of the impelling member, by causing a fluid pressure of fluid discharged from the pump chamber to act on the vane case.

In the vane-type hydraulic device described above, desirably, the rotor is disposed inside the rotor accommodating space in a state of having a prescribed amount of eccentricity with respect to an inner peripheral surface of the rotor accommodating member, and is driven to rotate in a state of having the prescribed amount of eccentricity.

Furthermore, desirably, the engaging sections are composed by: an engaging protrusion section provided to project in an axial direction of the drive shaft on one of the vane and the rotor accommodating member (for example, the guide protrusion 46, 52 in the embodiment); and an engaging groove section provided in a recessed fashion in the axial direction so as to be engageable with the engaging protrusion section, in the other one of the vane and the rotor accommodating member.

Moreover, desirably, the inner peripheral surface of the rotor accommodating member is formed in a circular shape; and the engaging protrusion section or the engaging groove section provided in the rotor accommodating member is formed in a circular shape concentrically with the inner peripheral surface of the rotor accommodating member.

Advantageous Effects of the Invention

The vane-type hydraulic device relating to the present invention is composed to include an engaging section which demarcates a pump chamber by moving a vane so as to follow the inner peripheral surface of the rotor accommodating member in a state of proximity with the inner peripheral surface of the rotor accommodating member. Therefore, it is possible to form a pump chamber by bringing a vane into close proximity with the inner peripheral surface of the rotor accommodating member, rather than using a composition which presses a vane against the inner peripheral surface of the rotor accommodating member by the discharge pressure of a fluid, for example. Consequently, compared to a composition in which the discharge pressure of the fluid is used to press vanes against the inner peripheral surface of the rotor accommodating member, it is possible to reduce the frictional resistance generated between the vanes and the rotor accommodating member when the rotor rotates, and the mechanical efficiency of the vane-type hydraulic device can be improved. Furthermore, the vanes can be moved so as to follow the inner peripheral surface of the rotor accommodating member simply by providing engaging sections which engage with each other for the vane and the rotor accommodating member, and therefore it is possible to achieve a simple and compact composition of the vane-type hydraulic device, compared to a composition in which a mechanism is provided to press the vanes against the inner peripheral surface of the rotor accommodating member by the discharge pressure of the fluid, for example.

In the vane-type hydraulic device described above, desirably, the rotor accommodating member is composed by a vane case and a case accommodating housing provided with a case accommodating space in which the vane case is accommodated movably. If a composition of this kind is adopted, it is possible to achieve a vane-type hydraulic device of a variable-volume type in which the volume of the pump chambers is changed by altering the amount of eccentricity of the inner peripheral surface of the vane case with respect to the rotor.

Furthermore, desirably, the amount of eccentricity is changed by the vane case moving linearly in the case accommodating space. According to this composition, the case accommodating housing and the vane case can be configured in a simple fashion, compared to a composition in which the vane case is accommodated swingably inside the case accommodating space, for example, and therefore manufacturing costs can be reduced and the vane-type hydraulic device can be made more compact in size.

Desirably, a case accommodating housing is provided with an impelling member which impels the vane case to one side in the direction of linear movement, and a composition is adopted in which the vane case is pressed to the other side against the impelling force by causing the fluid pressure to act on the vane case. If a composition of this kind is adopted, regardless of change in the speed of rotation of the rotor, it is possible to automatically implement control for changing the discharge flow volume of the fluid, while maintaining a uniform ejection pressure of the fluid.

In the vane-type hydraulic device described above, desirably, the rotor is disposed inside the rotor accommodating space in a state of having a prescribed amount of eccentricity with respect to an inner peripheral surface of the rotor accommodating member, and is driven to rotate in a state of having the prescribed amount of eccentricity. In the case of this composition, it is possible to achieve a compact vane-type hydraulic device of a fixed-volume type, which involves a small number of components compared to a variable-volume type of device.

Furthermore, desirably, the engaging sections are composed by an engaging protrusion section provided on one of the vane and the rotor accommodating member, and an engaging groove section provided on the other of the vane and the rotor accommodating member. By adopting a composition of this kind, it is possible to form the engaging sections in a simple and straightforward fashion, the manufacturing costs of the vane-type hydraulic device can be reduced, and furthermore, the vane-type hydraulic device can be composed in an even more simple and compact fashion.

Moreover, desirably, the inner peripheral surface of the rotor accommodating member is formed in a circular shape, and the engaging protrusion section or the engaging groove section provided on the rotor accommodating member is formed in a circular shape concentrically with the inner peripheral surface of the rotor accommodating member. When this composition is adopted, it is possible to form the inner peripheral surface of the rotor accommodating member and the engaging protrusion section or the engaging groove section of the rotor accommodating member in a simple and straightforward fashion, and yet further reduction of the manufacturing costs of the vane-type hydraulic device can be achieved.

DESCRIPTION OF THE EMBODIMENTS

Below, a desirable embodiment of the present invention is described with reference to the drawings. Firstly, a configuration of a vane pump 1 is described as one example of a vane-type hydraulic device to which the present invention is applied, on the basis of FIGS. 1 to 4. In the following description, the directions of the arrows shown in the respective drawings respectively define the front/rear, left/right and up/down directions.

Figure 1:
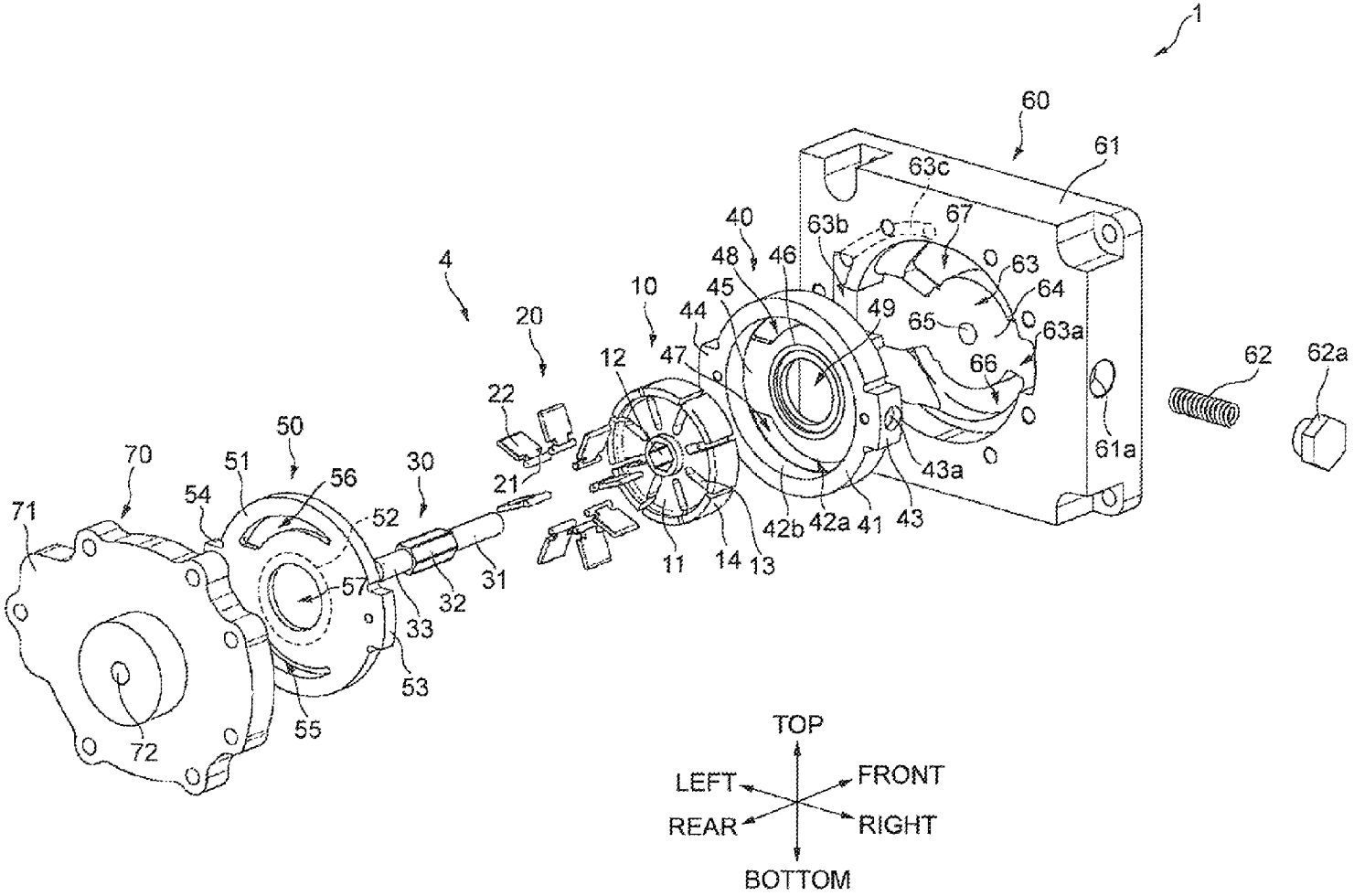
FIG. 1 is an exploded perspective diagram of a vane pump which is one example to which the present invention has been applied.

As shown in FIG. 1, the vane pump 1 is composed of a rotor 10, a plurality of vanes 20, a drive shaft 30, a front side vane case 40, a rear side vane case 50, a pump housing 60 and a pump cover 70. Below, an integrated body in which the rear side vane case 50 is fixed to the front side vane case 40 is called an integrated vane case 4.

As shown in FIG. 1, the rotor 10 is constituted by a rotor main body section 11 which is formed in a substantially circular disk shape and has a prescribed thickness in the front/rear direction. The rotor main body section 11 is provided with a shaft hole 12 passing therethrough the front/rear direction in the central portion thereof, the shaft hole 12 having a hexagonal cross-sectional shape. A plurality of slot sections 13 extending in radial directions are formed in the periphery of the shaft hole 12 in the rotor main body section 11. A pump chamber forming section 14 which forms a pump chamber is formed in an outer peripheral portion of the rotor main body section 11.

Figure 3:
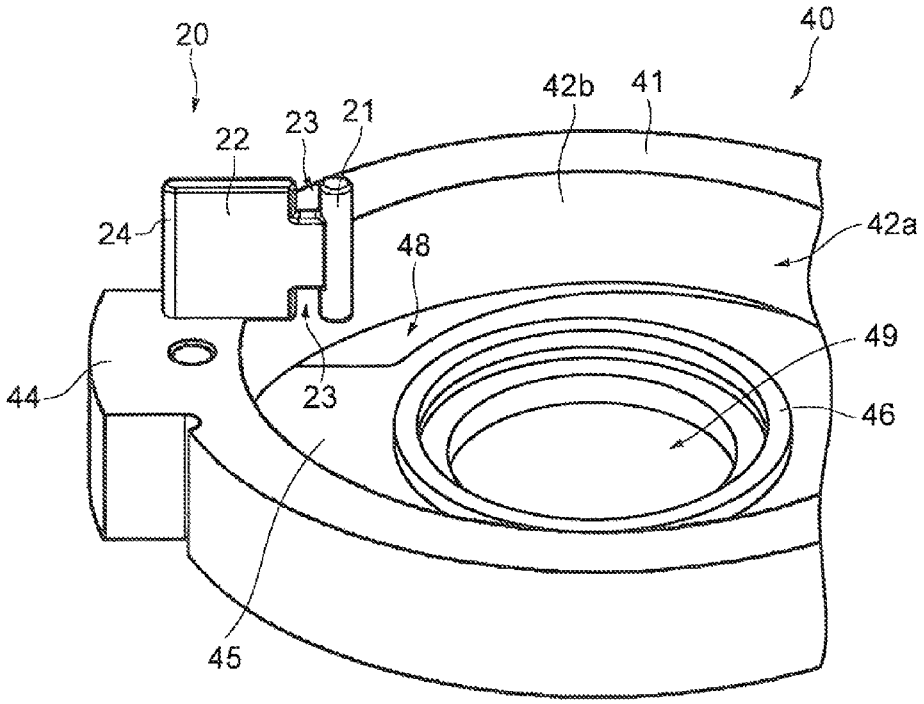
FIG. 3 is a perspective diagram showing a front side vane case and a vane.

As shown in FIG. 1 and FIG. 3, the vane 20 is constituted by a swinging axle section 21 formed in a column shape, and a vane main body section 22 which is formed in a substantially rectangular plate shape and is connected to a side face of the swinging axle section 21. A pair of engaging groove sections 23 which are recessed in the axial direction of the swinging axle section 21 are provided in a connecting portion of the swinging axle section 21 and the vane main body section 22. The vane 20 is formed in such a manner that the radial-direction width of the engaging groove sections 23 is greater than the radial-direction width of a guide protrusion 46 and guide protrusion 52, which are described below. A proximal end section 24 having a circular arc-shaped cross-section is formed in the front end portion of the vane main body section 22 on the opposite side to the swinging axle section 21.

Figure 4:
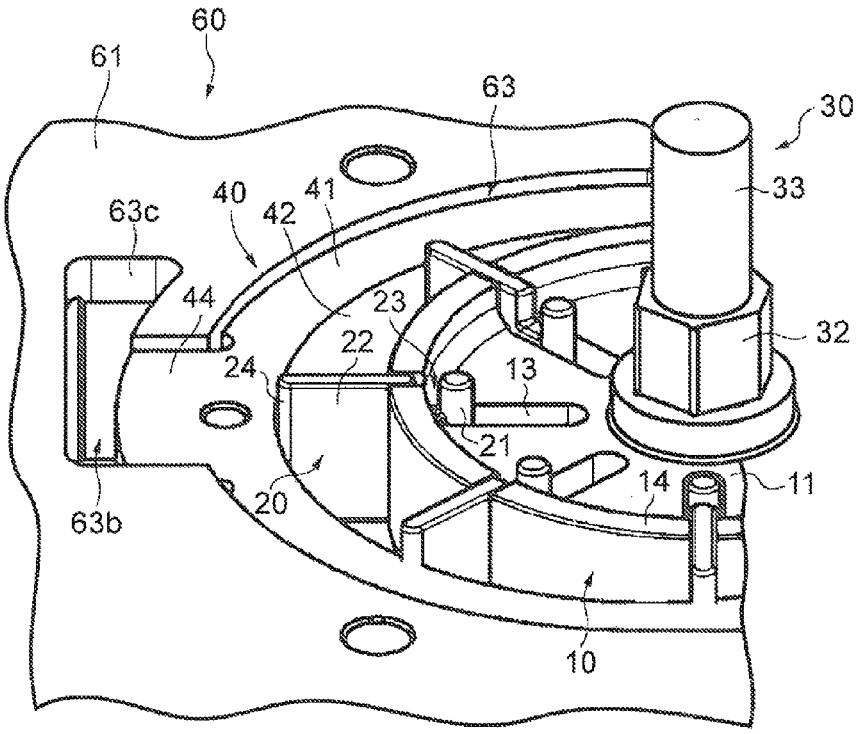
FIG. 4 is a perspective diagram showing a rotor and a front side vane case accommodated in a pump housing.

As shown in FIG. 1 and FIG. 4, the drive shaft 30 is formed in a rod shape extending in the front/rear direction, and a front side shaft section 31 supported rotatably on the pump housing 60, a central shaft section 32 having a hexagonal cross-sectional shape which fits into the shaft hole 12 of the rotor 10, and a rear side shaft section 33 which is supported rotatably on the pump cover 70.

As shown in FIG. 1 and FIG. 3, the front side vane case 40 is constituted by a circular ring-shaped case main body section 41, and a case bottom section 45 which covers the front surface side of the case main body section 41. A rotor accommodating space 42*a* which is open towards the rear side is formed by the case main body section 41 and the case bottom section 45.

The case main body section 41 has a proximal inner peripheral surface 42*b* having a circular cross-sectional shape formed on the inner side thereof, and a right side guide section 43 projecting rightwards is provided on the right side end portion thereof. A spring seating section 43*a* which is recessed in the leftward direction is formed in the right end surface of the right side guide section 43. On the other hand, a left side guide section 44 projecting leftwards is provided on the left side end portion of the case main body section 41.

A shaft escape hole 49 is formed to pass in the front/rear direction through the case bottom section 45 in a central portion thereof, and a circular ring-shaped guide protrusion 46 is formed so as to project rearwards concentrically with the proximal inner peripheral surface 42*b*, about the periphery of the shaft escape hole 49. A case side intake section 47 which extends in a long thin fashion in a substantial crescent shape from the left side portion towards the lower side portion is formed so as to pass in the front/rear direction through the case bottom section 45. Furthermore, a case side discharge section 48 which extends in a long thin fashion in a substantial crescent shape from the left side portion to the upper side portion is formed so as to pass in the front/rear direction through the case bottom section 45.

As shown in FIG. 1, the rear side vane case 50 is composed by a case lid section 51 which is formed in a substantially circular plate shape. A shaft escape hole 57 is formed to pass in the front/rear direction through the case lid section 51 in a central portion thereof. A guide protrusion 52 of the same diameter as the guide protrusion 46 of the front side vane case 40 is formed to project to the front side in a circular ring shape, at the periphery of the shaft escape hole 57 in the case lid section 51. A right side guide section 53 projecting rightwards is provided in the right side end portion of the case lid section 51, and a left side guide section 54 projecting leftwards is provided in the left side end portion of the case lid section 51. A case side intake section 55 which extends in a long thin fashion in a substantial crescent shape from the left side portion towards the lower side portion is formed so as to pass in the front/rear direction through the case lid section 51. Furthermore, a case side discharge section 56 which extends in a long thin fashion in a substantial crescent shape from the left side portion to the upper side portion is formed so as to pass in the front/rear direction through the case lid section 51. A vane case such as that described in the claims is composed by the front side vane case 40 and the rear side vane case 50.

As shown in FIG. 1, the pump housing 60 is constituted by a housing main body section 61 formed in a substantially cuboid shape and a compression spring 62.

A case accommodating space 63 for accommodating the integrated vane case 4 so as to be linearly movable in the left/right direction is formed in the central portion of the rear surface of the housing main body section 61, the case accommodating space 63 being recessed towards the front side and having an elliptical cross-sectional shape with the long axis thereof oriented in the left/right direction. A right side guide space 63*a* into which the right side guide section 43 of the case main body section 41 and the right side guide section 53 of the case lid section 51 fit slidably in the left/right direction is formed in the right side of the case accommodating space 63. Meanwhile, a left side guide space 63*b* into which the left side guide section 44 of the case main body section 41 and the left side guide section 54 of the case lid section 51 fit slidably in the left/right direction is formed in the left side of the case accommodating space 63.

A housing side support section 65 which rotatably supports the front side shaft section 31 of the drive shaft 30 is formed so as to pass in the front/rear direction through the space bottom section 64 which forms the bottom portion of the case accommodating space 63. A housing side intake section 66 which extends in a long thin fashion in a substantial crescent shape from the left side portion toward the lower side portion is formed so as to be recessed to the front side, in the space bottom section 64. Furthermore, a housing side discharge section 67 which extends in a long thin fashion in a substantial crescent shape from the left side portion toward the upper side portion is formed so as to be recessed to the front side, in the space bottom section 64.

Figure 2:
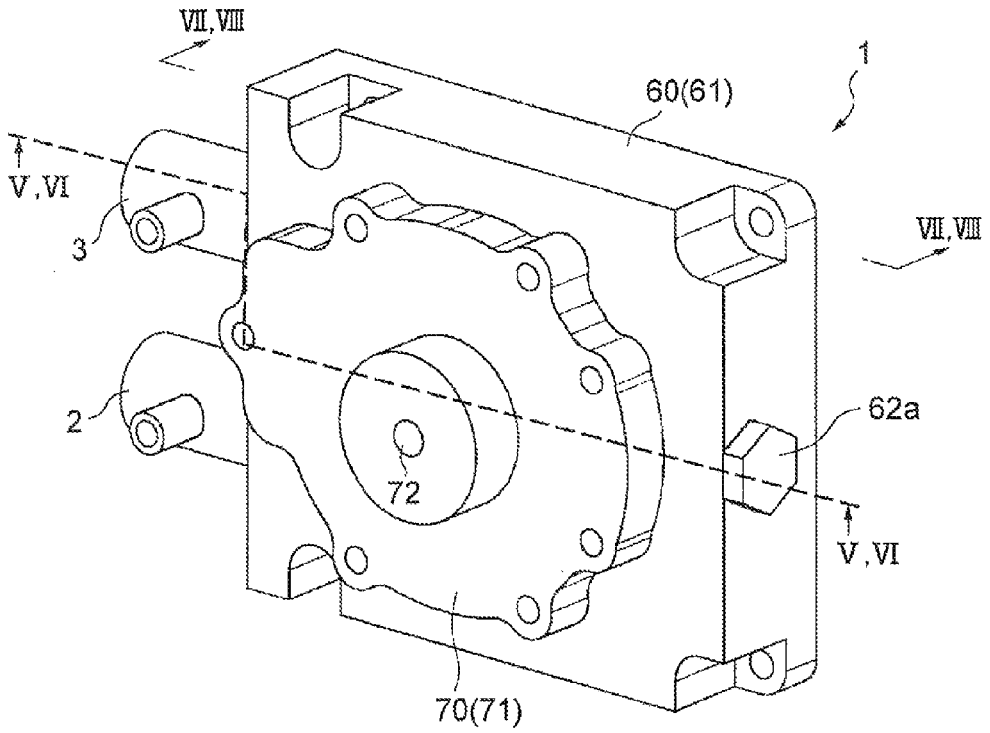
FIG. 2 is a perspective diagram of the vane pump.
Figure 2:
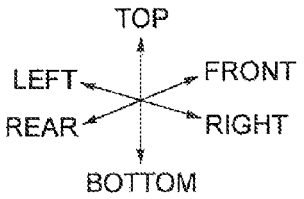

As shown in FIG. 2, an intake side line 2 connected to the left side lower part of the housing main body section 61 is connected to the housing side intake section 66 formed in the housing main body section 61. On the other hand, the discharge side line 3 which is connected to the left side upper portion of the housing main body section 61 is connected to the housing side discharge section 67 which is formed on the housing main body section 61. Furthermore, a fluid pressure introduction path 63*c* which connects the housing side discharge section 67 and the left side guide space 63*b* is formed in the housing main body section 61 (see FIG. 1 and FIG. 4).

The compression spring 62 is a spring which generates an impelling force in accordance with the amount of compression. As shown in FIG. 1, the compression spring 62 is inserted into a spring accommodating hole 61*a* which is formed extending in the left/right direction on the right side face of the housing main body section 61, and is accommodated and held inside the spring accommodating hole 61*a* by installing a cap 62*a* on the housing main body section 61.

As shown in FIG. 1, the pump cover 70 is composed by a cover main body section 71 which is formed in a substantially flat plate shape and has a size capable of covering, from the rear side, the case accommodating space 63, the right side guide space 63*a* and the left side guide space 63*b*, which are formed in the housing main body section 61. A cover side support section 72 which rotatably supports the rear side shaft section 33 of the drive shaft 30 is formed so as to pass in the front/rear direction through a central portion of the cover main body section 71. The rotor accommodating member described in the claims is constituted by the front side vane case 40, the rear side vane case 50, the pump housing 60 (housing main body section 61), and the pump cover 70 (cover main body section 71). Furthermore, the case accommodating housing described in the claims is composed by the pump housing 60 and the pump cover 70.

Figure 5:
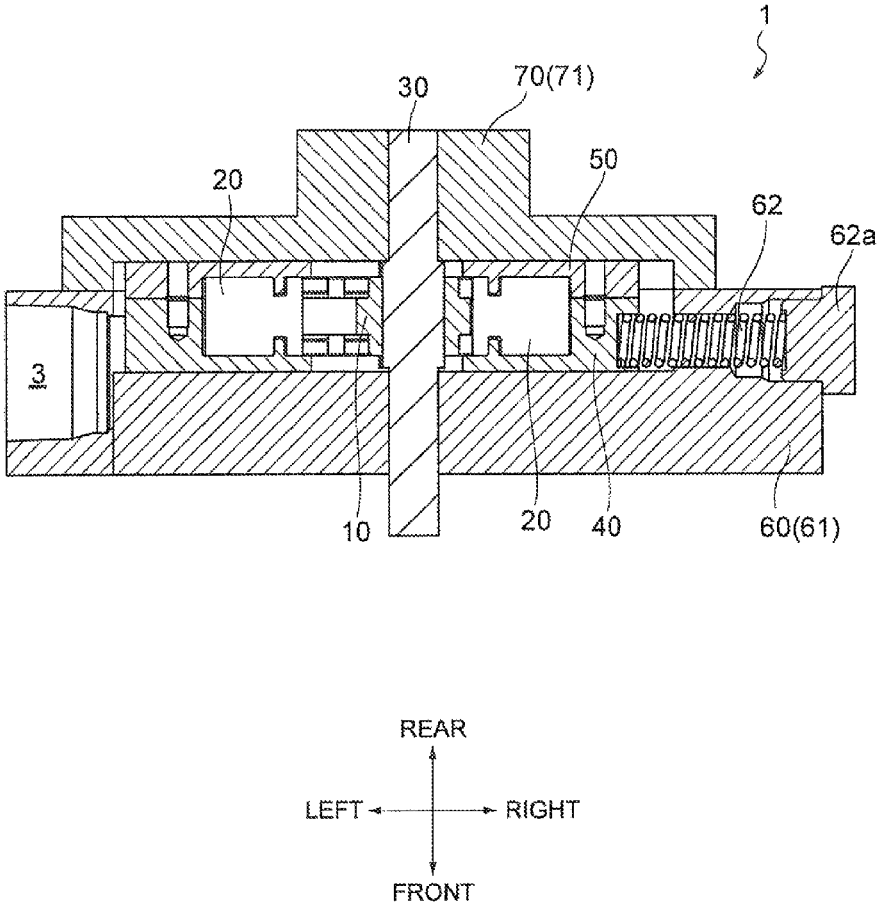
FIG. 5 is a cross-sectional diagram showing a portion V-V of FIG. 2.
Figure 6:
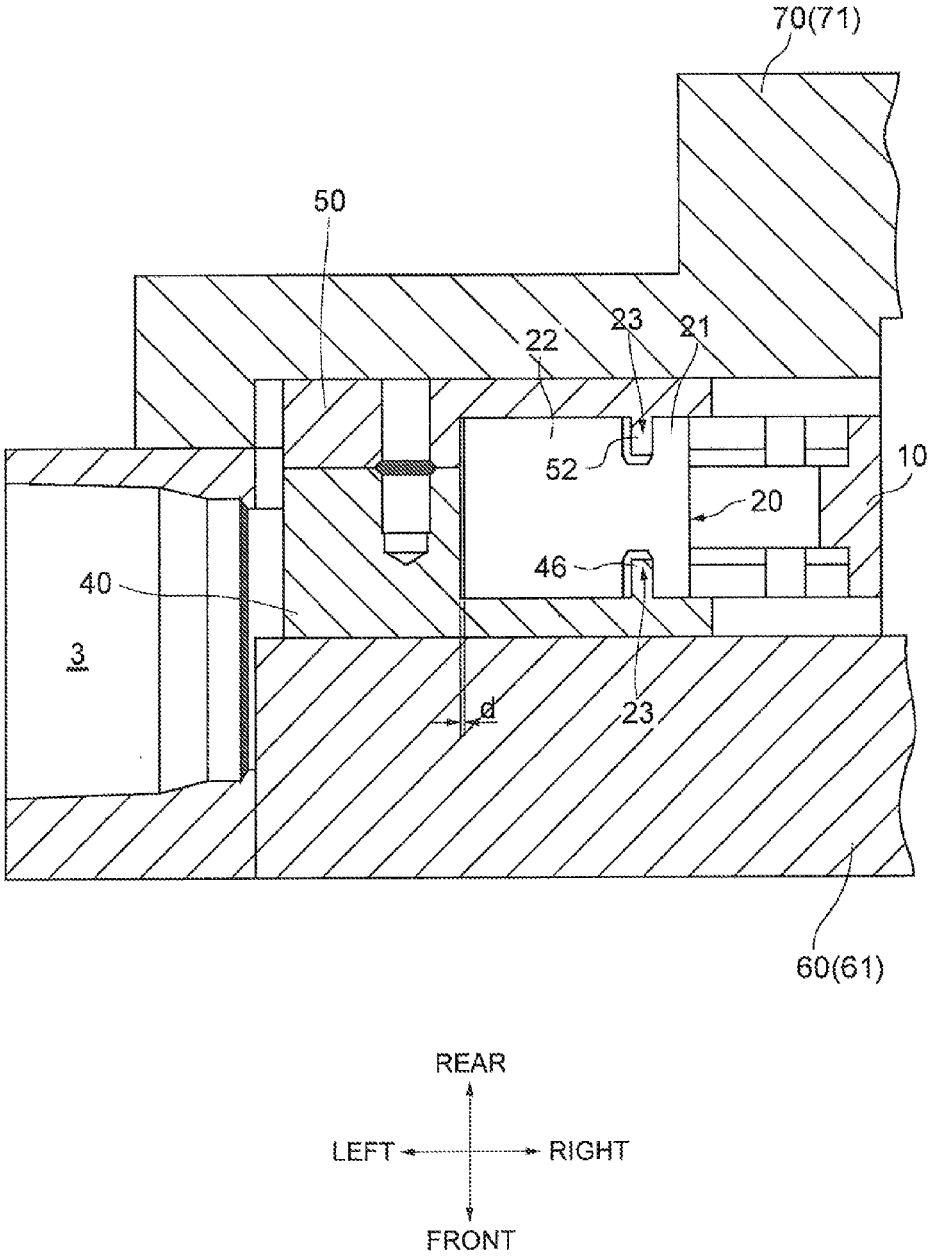
FIG. 6 is a partial enlarged diagram of FIG. 5.

Next, the assembly configuration of the vane pump 1 is described with additional reference to FIG. 5 and FIG. 6.

Firstly, the rotor 10 is inserted from the rear side and accommodated in the rotor accommodating space 42*a* formed in the front side vane case 40. Vanes 20 are inserted into the slot sections 13 of the rotor 10 which is accommodated in the rotor accommodating space 42*a*. In this case, the vanes 20 are inserted into the slot sections 13 with the swinging axle sections 21 thereof positioned on the inner side in the radial direction, and the engaging groove sections 23 of the vanes 20 are engaged with the guide protrusion 46 formed on the front side vane case 40. Thereupon, the rear side vane case 50 is installed on the front side vane case 40 so as to cover the rotor accommodating space 42*a* of the front side vane case 40 from the rear side, and the rear side vane case 50 is fixed to the front side vane case 40 by using fastening screws, or the like. In this case, by installing the rear side vane case 50 on the front side vane case 40 after adjusting the position, the guide protrusion 52 of the rear side vane case 50 is caused to engage with the engaging groove sections 23 of the vanes 20.

As described above, the integrated vane case 4 inside which the rotor 10 and the vanes 20 are accommodated is inserted from the rear side and accommodated in the case accommodating space 63 of the pump housing 60. In this case, the right side guide section 43 and the right side guide section 53 are fitted into the right side guide space 63*a* of the housing main body section 61, whereas the left side guide section 44 and the left side guide section 54 are fitted into and accommodated in the left side guide space 63*b* of the housing main body section 61. In this way, the integrated vane case 4 is accommodated in the case accommodating space 63 so as to be linearly movable in the left/right direction.

By inserting the drive shaft 30 from the rear side into the integrated vane case 4 accommodated in the case accommodating space 63, the front side shaft section 31 is inserted through and supported by the housing side support section 65 of the housing main body section 61, and the central shaft section 32 is fitted into the shaft hole 12 of the rotor 10. Consequently, the pump cover 70 is installed on the housing main body section 61 so as to cover the case accommodating space 63 of the pump housing 60 from the rear side, and the pump cover 70 is fixed to the pump housing 60 using fastening screws, or the like. In this case, the pump cover 70 is installed on the housing main body section 61 when the rear side shaft section 33 of the drive shaft 30 has been inserted through and supported by the cover side support section 72 of the pump cover 70.

Next, the compression spring 62 is inserted into the spring accommodating hole 61*a* of the housing main body section 61, the left end portion of the compression spring 62 is inserted into a spring seating section 43*a*, and the cap 62*a* is installed in the spring accommodating hole 61*a* (see FIG. 5). The vane pump 1 is assembled as described above. In this assembled state, the integrated vane case 4 is accommodated inside the case accommodating space 63 in a state of being pressed leftwards by the compression spring 62 (see FIG. 7A). Furthermore, the drive shaft 30 is connected to the output shaft of a drive source, such as an electric motor, for example, in such a manner that rotation of the drive shaft 30 can be driven by driving the electric motor.

FIG. 5 and FIG. 6 show cross-sectional diagrams close up against the rear surface of the rear side vane case 50, by showing a depiction that partially omits the composition of the pump cover 70. However, an intake side space (not illustrated) which is recessed towards the rear is formed in the portion corresponding to the case side intake section 55, and a discharge side space (not illustrated) which is recessed towards the rear is formed in the portion corresponding to the case side discharge section 56. When the electric motor is driven to rotate as described below, fluid is taken into the pump chamber from the intake side space via the case side intake section 55, and the fluid taken into the pump chamber is discharged into the discharge side space via the case side discharge section 56.

Figure 7A:
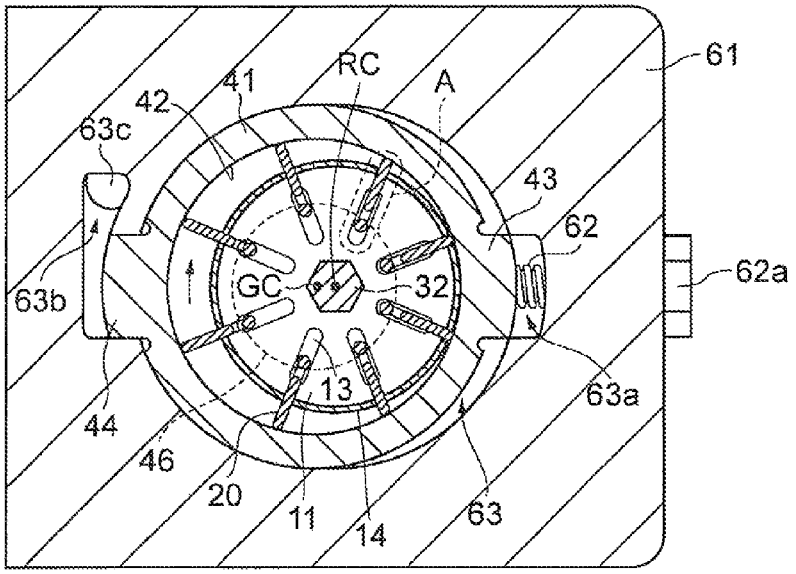
FIG. 7A is a cross-sectional diagram showing a portion VII-VII in FIG. 2 (a state where the pump capacity is a maximum)
Figure 7B:
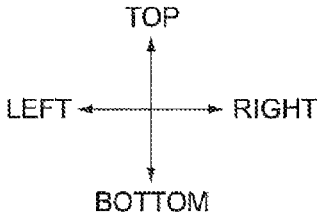
FIG. 7B is an enlarged diagram of portion A in FIG. 7A.
Figure 7B:
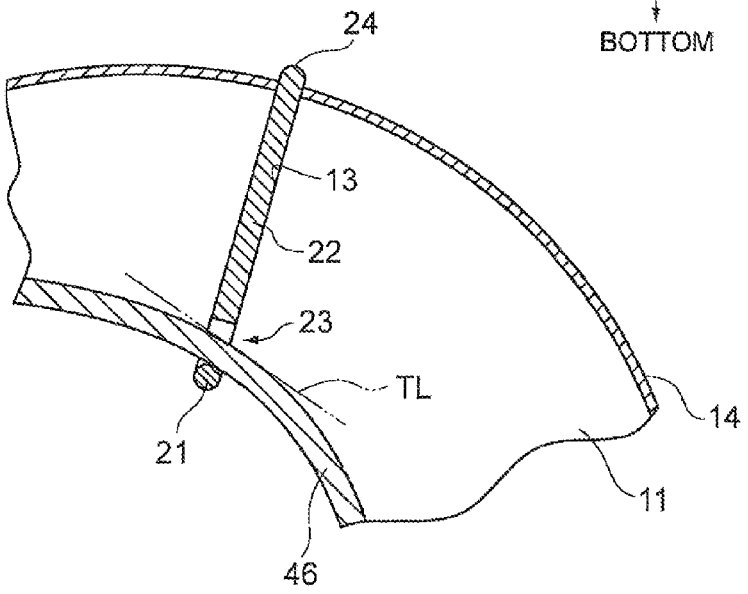

Next, the operation of the vane pump 1 is described with additional reference to FIG. 7 and FIG. 8.

Firstly, since the discharge pressure of the fluid is not supplied to the left side guide space 63*b* from the fluid pressure introduction path 63*c*, before the electric motor is driven, then as shown in FIG. 7A, the integrated vane case 4 is pressed to the left side in the case accommodating space 63 by means of the compression spring 62. In other words, the center position GC of the proximal inner peripheral surface 42*b* (the center position of the guide protrusion 46) is shifted to the left side with respect to the center position RC of the rotor 10, and the integrated vane case 4 is situated eccentrically to the left side with respect to the rotor 10. The engaging groove sections 23 of each of the vanes 20 are engaged with the guide protrusion 46 and the guide protrusion 52, and furthermore, the proximal end sections 24 of the vanes 20 are near to the proximal inner peripheral surface 42*b*. Here, the region surrounded by the pump chamber forming section 14 of the rotor 10, the proximal inner peripheral surface 42*b* of the front side vane case 40, the case bottom section 45 and the case lid section 51 is demarcated by the vanes 20 to form a plurality of pump chambers.

In this state, when the drive shaft 30 is driven to rotate by the electric motor and the rotor 10 is rotated in the clockwise direction in FIG. 7A, then the vanes 20 rotate in an integrated fashion with the rotor 10, while the engaging groove sections 23 of the vanes 20 remained engaged with the guide protrusion 46 and the guide protrusion 52, and the proximal end sections 24 thereof follow the proximal inner peripheral surface 42*b*. In this case, in the lower side portion of the rotor 10 shown in FIG. 7A, due to the engagement between the guide protrusion 46 and guide protrusion 52, and the engaging groove sections 23, the vanes 20 gradually project out radially from the slot sections 13, with the rotation of the rotor 10, in such a manner that the vanes 20 follow the proximal inner peripheral surface 42*b*. Consequently, in the lower side portion of the rotor 10, the volume of the pump chambers gradually increases in accordance with the rotation of the rotor 10, and a negative pressure corresponding to the amount of volume change is generated in each of the pump chambers. The case side intake section 47 and the case side intake section 55 are respectively formed so as to correspond to the portions where the volume of the pump chambers increases in accordance with the rotation of the rotor 10. Therefore, in the lower side portion of the rotor 10, the fluid inside the intake side line 2 is taken into the pump chambers via the case side intake section 47 (housing side intake section 66) and the case side intake section 55, due to the negative pressure generated in the pump chambers.

The fluid taken into the pump chambers in the lower side portion of the rotor 10 is conveyed in this state to the upper side portion of the rotor 10, due to the rotation of the rotor 10. In the upper side portion of the rotor 10, conversely to the lower side portion of the rotor 10, due to the engagement between the guide protrusion 46 and guide protrusion 52, and the engaging groove sections 23, the vanes 20 gradually retract inside the slot sections 13 in accordance with the rotation of the rotor 10, so as to follow the proximal inner peripheral surface 42*b*. Therefore, in the upper side portion of the rotor 10, the volume of the pump chambers gradually decreases in accordance with the rotation of the rotor 10. The case side discharge section 48 and the case side discharge section 56 are formed so as to correspond to the portions where the volume of the pump chambers decreases in accordance with the rotation of the rotor 10. Therefore, in the upper side portion of the rotor 10, the fluid in the pump chambers is discharged to the discharge side line 3 via the case side discharge section 48 (housing side discharge section 67) and the case side discharge section 56, in accordance with the decrease in the volume of the pump chambers. In this way, in a state where the integrated vane case 4 is pressed to the left side inside the case accommodating space 63 (the state where the amount of eccentricity of the integrated vane case with respect to the rotor 10 is a maximum), the amount of volume change in the pump chambers when the rotor 10 is rotated is a maximum, and the pump capacity of the vane pump 1 is a maximum.

In the state shown in FIG. 7A, the integrated vane case 4 is situated eccentrically to the left side with respect to the rotor 10, and therefore the slot sections 13 in the portion indicated by A in FIG. 7A, for example, are positioned so as to extend in an oblique direction, rather than a perpendicular direction, with respect to the tangent TL to the guide protrusion 46, as shown in FIG. 7B. As described above, since the engaging groove sections 23 are formed so as to have a radial-direction width which is greater than the radial-direction width of the guide protrusion 46, then the vanes 20 swing towards the slot sections 13 about the swinging axle sections 21, while the engaging groove sections 23 remain engaged with the guide protrusion 46. In this way, since the vanes 20 perform a swinging movement so as to follow the orientation of the slot sections 13, the vanes 20 rotate in an integrated fashion with the rotor 10 so as to follow the proximal inner peripheral surface 42*b*, while maintaining a uniform opposition gap d between the proximal end sections 24 and the proximal inner peripheral surface 42*b* (see FIG. 6).

In the vane pump 1 to which the present invention has been applied, when the rotor 10 is rotated, the swinging axle sections 21 of the vanes 20 slide against the inner peripheral surfaces of the guide protrusion 46 and the guide protrusion 52, in the radial direction of the rotor 10, and the proximal end sections 24 and the proximal inner peripheral surface 42*b* separate from each other. Furthermore, the swinging axle sections 21 are formed in a column shape and therefore rotate in unison with the rotor 10 along the guide protrusion 46 and the guide protrusion 52, while contacting the inner peripheral surfaces of the guide protrusion 46 and the guide protrusion 52 with a minimum contact surface area. In this way, since the vanes 20 are composed so as to contact the inner peripheral surface of the guide protrusion 46 and the guide protrusion 52 with a minimum contact surface area, then it is possible to greatly reduce the frictional resistance when the rotor is rotated, compared to a prior configuration in which the rotor is rotated in a state where, for example, all of the front tips of the vanes in the radial direction are pressed against the inner peripheral surface of the pump housing. Furthermore, since a composition is adopted in which the swinging axle sections 21 contact the inner peripheral surfaces of the guide protrusion 46 and the guide protrusion 52 with a minimum contact surface area, then there is virtually no change in the frictional resistance between the guide protrusion 46 and guide protrusion 52, and the vanes 20, when the rotor 10 is rotated, whereby the rotor 10 rotates smoothly.

However, in a vane pump having a prior art configuration, the vanes press against the inner peripheral surface of the pump housing at all times, and consequently there is a problem in that the front tips of the vanes are liable to wear, especially in cases where a fluid having low lubricating properties is being taken into and discharged from the pump chambers. On the other hand, in the vane pump 1 to which the present invention is applied, a configuration is adopted in which an opposition gap d is maintained between the proximal end sections 24 and the proximal inner peripheral surface 42*d* when the rotor 10 is rotated, and therefore even in cases where a fluid having low lubricating properties is taken into and discharged from the pump chambers, it is possible to prevent wear of the proximal end sections 24 of the vanes 20.

In this way, when the rotor 10 is rotated and the fluid in the intake side line 2 is discharged to the discharge side line 3, the fluid in the discharge side line 3 is guided to the left side guide space 63*b* via the fluid pressure introduction path 63*c*. Consequently, a force corresponding to the fluid pressure (discharge pressure) of the fluid in the discharge side line 3 (a force moving the integrated vane case 4 to the right side) acts on the integrated vane case 4. If, for example, the speed of rotation of the drive shaft 30 is raised, the discharge pressure of the fluid in the discharge side line 3 rises to exhibit at least a prescribed pressure, and the force seeking to move the integrated vane case 4 to the right side becomes greater than the force of the compression spring 62 pressing the integrated vane case 4 to the left side, then the integrated vane case 4 is caused to slide directly rightwards while being guided by the right side guide space 63*a* and the left side guide space 63*b*. In other words, the integrated vane case 4 is moved in a direction by which the amount of eccentricity of the integrated vane case 4 with respect to the rotor 10 decreases, inside the case accommodating space 63.

Figure 8A:
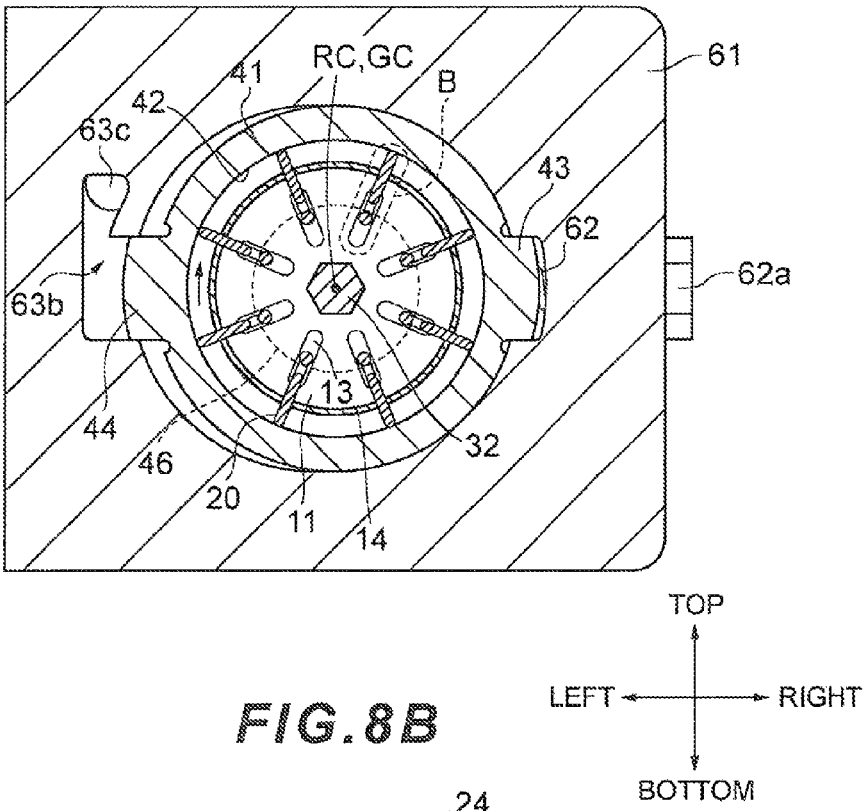
FIG. 8A is a cross-sectional diagram showing a portion VIII-VIII in FIG. 2 (a state where the pump capacity is a minimum)

When the discharge pressure of the fluid in the discharge side line 3 rises further, then as shown in FIG. 8A, the integrated vane case 4 is caused to slide until becoming pressed against the right side of the case accommodating space 63, by the discharge pressure. In a state where the integrated vane case 4 is pressed against the right side of the case accommodating space 63, the center position RC of the rotor 10 and the center position GC of the proximal inner peripheral surface 42*b* virtually coincide with each other, and the amount of eccentricity between the rotor 10 and the proximal inner peripheral surface 42*b* becomes virtually zero.

Figure 8B:
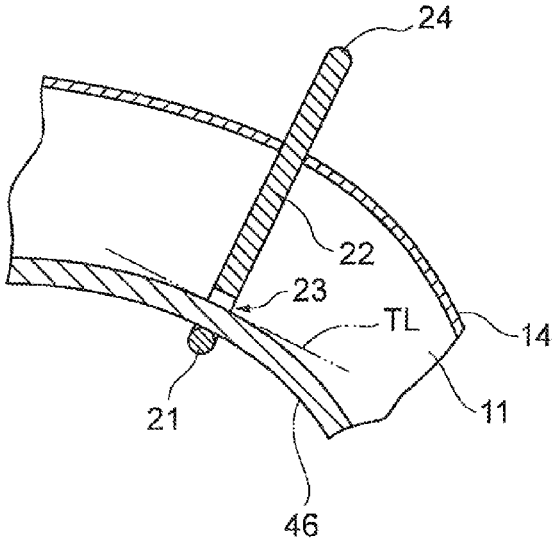
FIG. 8B is an enlarged diagram of portion B in FIG. 8A.

In the state shown in FIG. 8A, since the integrated vane case 4 is hardly eccentric at all with respect to the rotor 10, then the slot sections 13 extend in a direction that is virtually perpendicular with respect to the tangent TL to the guide protrusion 46, as shown in FIG. 8B, for example. The vanes 20 each rotate in an integrated fashion with the rotor 10 so as to follow the proximal inner peripheral surface 42*b*, while maintaining a uniform opposition gap d between the proximal end section 24 and the proximal inner peripheral surface 42*b*, due to performing a swinging movement towards the slot section 13 (in a direction that is virtually perpendicular with respect to the tangent TL) about the swinging axle section 21 (see FIG. 6). In the state shown in FIG. 8A, the volume of the pump chambers hardly changes at all with the rotation of the rotor 10, and therefore the volume of fluid taken into the respective pump chambers and the discharge volume of the fluid ejected from the pump chambers decreases in comparison with the state shown in FIG. 7A. More specifically, in this case, the pump capacity of the vane pump 1 becomes a minimum.

By changing the amount of eccentricity through causing the integrated vane case 4 to slide in the left/right direction inside the case accommodating space 63, in accordance with the discharge pressure of the fluid in the discharge side line 3, it is possible to change the amount of volume change in the pump chambers in accordance with this amount of eccentricity. When the amount of change in the volume of the pump chamber changes, the discharge flow volume of the fluid discharged when the rotor 10 performs a prescribed rotation, in other words, the pump capacity of the vane pump 1, changes. Therefore, the vane pump 1 uses a compression spring 62 having a spring coefficient whereby the discharge flow volume of fluid can be changed while maintaining the discharge pressure of the fluid in the discharge side line 3 at a prescribed pressure, by guiding the fluid in the discharge side line 3 to the left side guide space 63*b*. Consequently, even if the speed of rotation of the rotor 10 is changed, it is possible to automatically implement control for changing the discharge flow volume of the fluid, while maintaining a uniform ejection pressure of the fluid.

Figure 9:
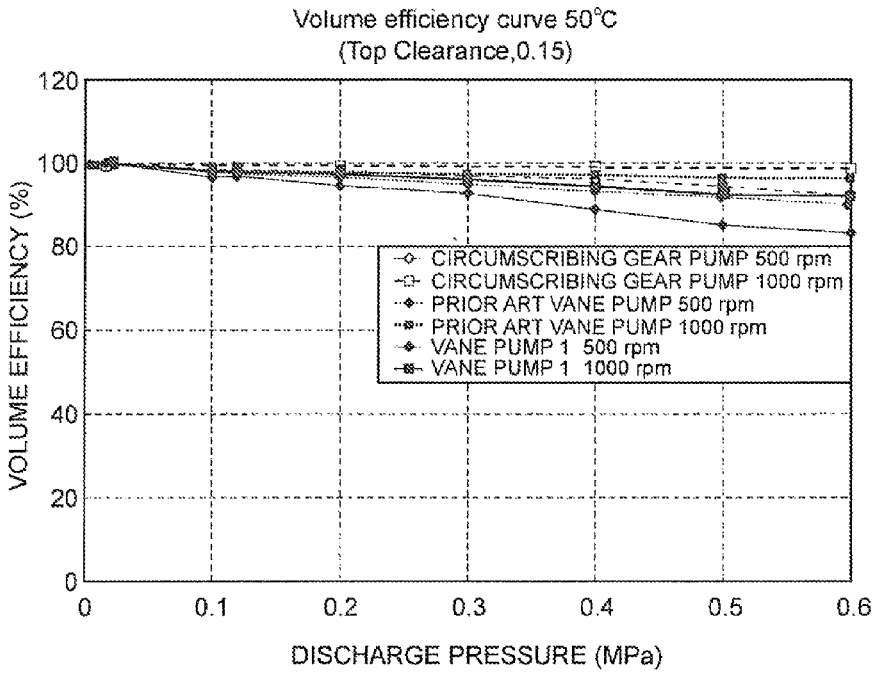
FIG. 9 is a graph showing a relationship between the discharge pressure and the volume efficiency.
Figure 10:
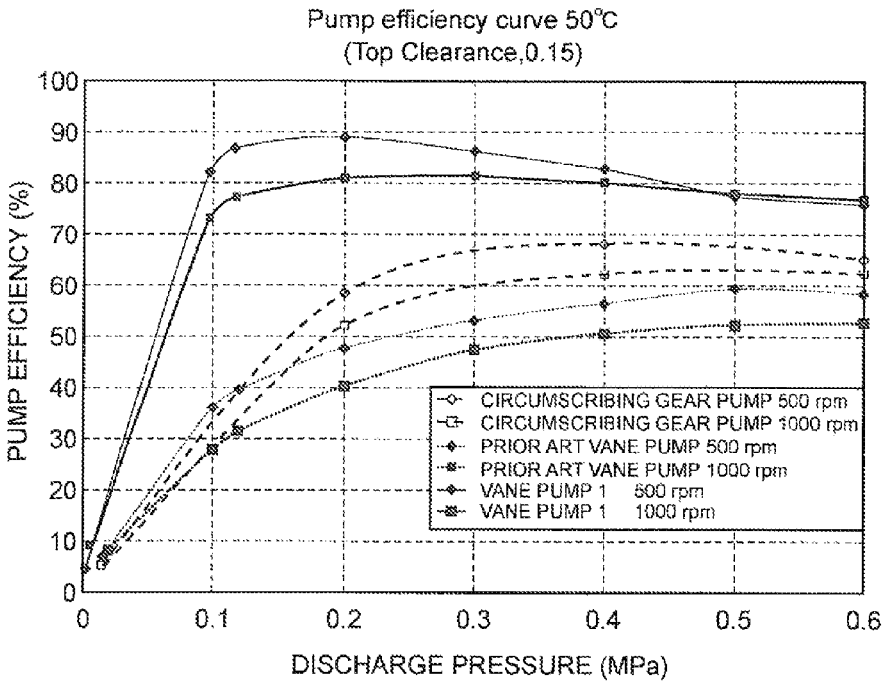
FIG. 10 is a graph showing a relationship between the discharge pressure and the pump efficiency.
Figure 11:
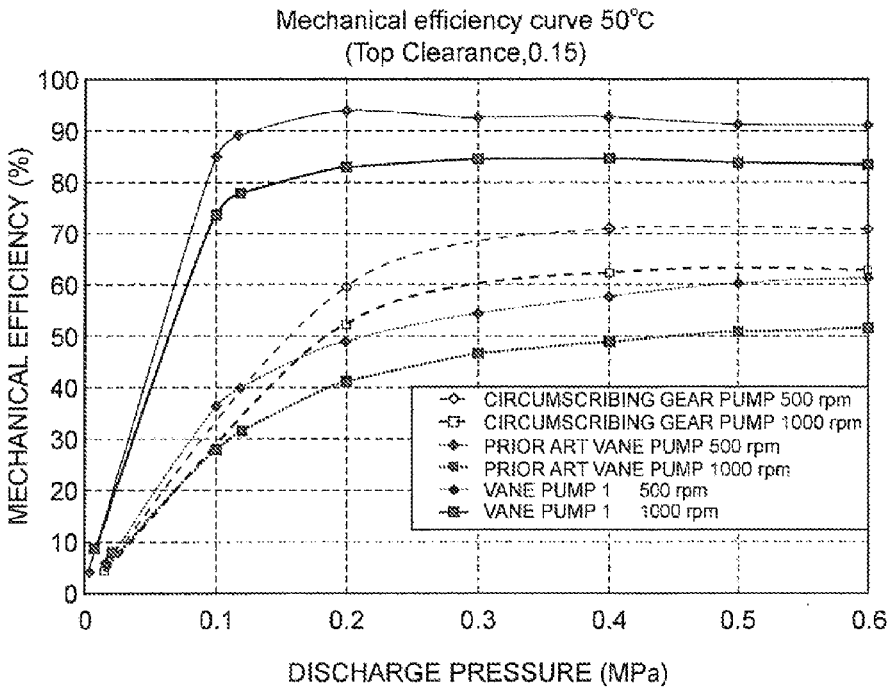
FIG. 11 is a graph showing a relationship between the discharge pressure and the mechanical efficiency.

The respective efficiencies of the vane pump 1 composed in this way are described here with reference to FIGS. 9 to 11. FIGS. 9 to 11 show the measurement results of a case where the opposition gap d between the proximal end sections 24 and proximal inner peripheral surface 42*b* in the vane pump 1 to which the present invention is applied is set to 0.15 mm, and the fluid temperature is set to 50° C. In the respective diagrams, apart from the measurement results for the vane pump 1 which serves as a reference for comparison, the measurement results are also shown for a circumscribing gear pump and a prior art vane pump in which the vanes are pressed against the inner peripheral surface of a vane case by a force corresponding to the discharge pressure, through guiding the discharge pressure of the fluid to a vane back pressure chamber. Furthermore, for each of the pumps, measurements were taken with the input revolutions per minute set to 500 rpm, and to 1000 rpm.

FIG. 9 shows a graph of the relationship between the discharge pressure and the volume efficiency. Here, the pump volume efficiency is expressed as a ratio of the discharge flow volume of the fluid at the respective discharge pressures, with respect to the discharge flow volume of the fluid at zero load. As FIG. 9 reveals, the vane pump 1 has reduced volume efficiency corresponding to the provision of a gap between the proximal end section 24 and the proximal inner peripheral surface 42*b*, compared to the circumscribing gear pump and the prior art vane pump.

FIG. 10 shows a graph of the relationship between the discharge pressure and the pump efficiency. Here, the pump efficiency is expressed as the ratio of the output of the pump with respect to the input to the drive source (such as an electric motor). As FIG. 10 reveals, in the vane pump 1, the surface area of the sliding portion when the rotor 10 is rotated is small, and the frictional resistance is reduced, compared to the circumscribing gear pump and the prior art vane pump, and therefore the pump efficiency can be improved accordingly.

FIG. 11 shows a graph of the relationship between discharge pressure and mechanical efficiency. Here, mechanical efficiency is expressed by the ratio of the work actually performed by the pump to the supplied energy. As FIG. 11 reveals, in the vane pump 1, the surface area of the sliding portion when the rotor 10 is rotated is small, and the frictional resistance is reduced, compared to the circumscribing gear pump and the prior art vane pump, and therefore the mechanical efficiency can be improved accordingly.

In the embodiment described above, an example is described in which a guide protrusion 46 is formed on the front side vane case 40, and a guide protrusion 52 is formed on the rear side vane case 50, and furthermore a pair of engaging groove sections 23 is formed in the vanes 20, but the present invention is not limited to this configuration. For example, it is also possible to adopt a configuration in which, conversely, a pair of engaging protrusions which project in the front/rear direction is formed on the vanes 20, and furthermore, engaging groove sections capable of engaging with these engaging protrusions are formed in a ring shape in the front side vane case 40 and the rear side vane case 50.

Furthermore, in the embodiment described above, an example is given in which a proximal inner peripheral surface 42*b* is formed with a circular cross-sectional shape, and a circular ring-shaped guide protrusion 46 and guide protrusion 52 are provided so as to correspond with the cross-sectional shape of the proximal inner peripheral surface 42*b*, but the present invention is not limited to this example. For instance, it is also possible to adopt a composition in which a front side vane case formed with a proximal inner peripheral surface having an elliptical cross-sectional shape is used, and elliptical ring-shaped guide protrusions are provided in the front side vane case and the rear side vane case so as to correspond to the cross-sectional shape of this proximal inner peripheral surface.

In the embodiment described above, an example of a configuration is given in which the pump capacity is changed by moving the integrated vane case 4 in a direction which reduces the amount of eccentricity, by guiding the fluid in the discharge side line 3 to the left side guide space 63*b* via the fluid pressure introduction path 63*c*, but the application of the present invention is not limited to this configuration example. For example, a composition may be adopted in which, instead of providing a fluid pressure introduction path 63*c*, the movement of the integrated vane case 4 is controlled by guiding a controlled hydraulic pressure to the left side guide space 63*b* so as to apply a force corresponding to this control hydraulic pressure to the integrated vane case 4.

As described above, in the vane pump 1, fluid leaks from the high pressure side to the low pressure side via a gap which is provided between the proximal end section 24 and the proximal inner peripheral surface 42*b*, and therefore the volume efficiency declines in accordance with this leakage, in comparison with a vane pump of a prior art configuration in which the front tips of vanes are pressed against the inner peripheral surface of the pump housing. However, since this leakage amount is small when the discharge pressure is low, then the pump is suitable for applications where a low discharge pressure is required, for example, as a pump for circulating lubricating oil inside an engine. Furthermore, the fluid which is taken in and discharged by the pump is not limited to oil, and it is also possible to take in and discharge water, for example.

In the vane pump 1 described above, a centrifugal force acts in an outward radial direction on the vanes 20 when the rotor 10 rotates, but on the other hand, when fluid is discharged from the pump chambers, a force acts in an inward radial direction (central direction) on the vanes 20. Therefore, the centrifugal force acting in the outward radial direction is cancelled out by (diminished by) the force acting in the inward radial direction, and therefore wear of the inner peripheral surfaces of the guide protrusions 46, 52, and the swinging axle sections 21, can be reduced. Furthermore, since it is possible to restrict the frictional resistance occurring when the swinging axle sections 21 slide against the inner peripheral surfaces on the inside of the guide protrusions 46, 52, then the mechanical efficiency of the vane pump 1 can be improved.

In the embodiment described above, an example was given in which the present invention is applied to a variable-volume type of vane pump 1 in which the pump capacity (volume of the pump chambers) is altered by moving the integrated vane case 4 inside the case accommodating space 63 so as to change the amount of eccentricity, but the application of the present invention is not limited to a vane pump of this type. For example, the present invention may also be applied to a fixed-volume type of vane pump, in which, in the vane pump 1, the front side vane case 40 is formed in an integrated fashion with the housing main body section 61, and the rear side vane case 50 is formed in an integrated fashion with the cover main body section 71, whereby the rotor 10 is accommodated in an eccentric fashion with respect to the inner peripheral surface of the pump housing 60 (housing main body section 61). If applied to a vane pump of a fixed-volume type such as this, the vanes 20 rotate in an integrated fashion with the rotor 10 so as to follow the inner peripheral surface of the housing main body section 61, while maintaining a uniform opposition gap between the proximal end sections 24 and inner peripheral surface of the housing main body section 61. In this case, the amount of eccentricity of the rotor 10 with respect to the inner peripheral surface of the pump housing 60 is determined in accordance with the formation position of the housing side support section 65 in the pump housing 60, and the volume of the pump chambers is a volume corresponding to this amount of eccentricity. In this fixed-volume type of vane pump, the discharge flow volume of the fluid is controlled by controlling the speed of rotation of the rotor 10, for example.

In the embodiment described above, an example was given in which the present invention is applied to a variable-volume type of vane pump 1 in which the amount of eccentricity is altered by moving the integrated vane case 4 linearly inside the case accommodating space 63, but the application of the present invention is not limited to a vane pump of this type. For instance, the present invention can also be applied to a variable-volume type of vane pump in which the amount of eccentricity is altered by causing the integrated vane case 4 to perform a swinging movement inside the case accommodating space 63.

In the embodiment described above, an example was given in which the present invention is applied to a vane pump 1 which takes in and discharges fluid, by driving rotation of the drive shaft 30 by an electric motor, for example, but the application of the present invention is not limited to this vane pump. More specifically, the present invention can be applied to a wide range of vane-type hydraulic devices with a rotor 10 on which vanes 20 are provided in a retractable fashion; for example, the present invention can also be applied to a vane motor in which a rotor 10 is driven to rotate by discharging fluid that has been supplied from an intake side line 2, from a discharge side line 3, in such a manner that the rotational drive force of the rotor 10 is extracted via a drive shaft 30.

EXPLANATION OF NUMERALS AND CHARACTERS

1 vane pump (vane-type hydraulic device)
10 rotor
13 slot section
20 vane
23 engaging groove section
30 drive shaft
40 front side vane case (rotor accommodating member, vane case)
42*a* a rotor accommodating space
42*b* proximal inner peripheral surface (inner peripheral surface of rotor accommodating member)
46 guide protrusion (engaging protrusion section)
50 rear side vane case (rotor accommodating member, vane case)
52 guide protrusion (engaging protrusion section)
60 pump housing (rotor accommodating member, case accommodating housing)
62 compression spring (impelling member)
63 case accommodating space
70 pump cover (rotor accommodating member, case accommodating housing)

The invention claimed is:

1. A vane-type hydraulic device, comprising:

a rotor accommodating member provided with a rotor accommodating space;

a drive shaft supported by the rotor accommodating member;

a rotor provided with a slot section formed to extend in a radial direction of the rotor, the rotor being disposed inside the rotor accommodating space and being driven to rotate about the drive shaft by the drive shaft; and a vane provided retractably in the radial direction in the slot section, wherein the vane and the rotor accommodating member are provided with engaging sections which engage with one another; and the engaging sections are composed so as to cause the vane to move following an inner peripheral surface of the rotor accommodating member in a state where the vane is proximate to the inner peripheral surface of the rotor accommodating member, in accordance with rotation of the rotor, as well as to demarcate a pump chamber by the vane which is in proximity to the inner peripheral surface of the rotor accommodating member;

the engaging sections are composed by:

an engaging protrusion section projecting inwardly in an axial direction of the drive shaft and formed on the rotor accommodating member; and an engaging groove section provided on the vane in a recessed fashion inwardly in the axial direction so as to be engageable with the engaging protrusion section.

2. The vane-type hydraulic device according to claim 1, wherein the rotor accommodating member is composed by:

a vane case provided with the rotor accommodating space; and a case accommodating housing provided with a case accommodating space which accommodates the vane case movably in a plane perpendicular to the drive shaft, and an amount of eccentricity of the inner peripheral surface of the vane case with respect to the rotor is changed by moving the vane case in the case accommodating space of the case accommodating housing.

3. The vane-type hydraulic device according to claim 2, wherein the vane case is accommodated inside the case accommodating space in a linearly movable fashion; and the amount of eccentricity changes due to the vane case moving linearly inside the case accommodating space.

4. The vane-type hydraulic device according to claim 2, wherein the case accommodating housing is provided with an impelling member which impels the vane case towards one side in the direction of linear movement; and the vane case is pressed to the other side against the impelling force of the impelling member, due to a fluid pressure of fluid, which is discharged from the pump chamber, acting on the vane case.

5. The vane-type hydraulic device according to claim 1, wherein the rotor is disposed inside the rotor accommodating space in a state of having a prescribed amount of eccentricity with respect to an inner peripheral surface of the rotor accommodating member, and is driven to rotate in a state of having the prescribed amount of eccentricity.

6. The vane-type hydraulic device according to claim 1, wherein the inner peripheral surface of the rotor accommodating member is formed in a circular shape; and the engaging protrusion section or the engaging groove section provided in the rotor accommodating member is formed in a circular shape concentrically with the inner peripheral surface of the rotor accommodating member.

* * * * *